US010655238B2

(12) United States Patent
Kim et al.

(10) Patent No.: US 10,655,238 B2
(45) Date of Patent: May 19, 2020

(54) MANUFACTURING METHOD FOR CARBONFIBER GROWN METAL OXIDE

(71) Applicant: INDUSTRIAL COOPERATION FOUNDATION CHONBUK NATIONAL UNIVERSITY, Jeonju-si, Jeollabuk-do (KR)

(72) Inventors: Seong Su Kim, Jeonju-si (KR); Seung A Song, Jeonju-si (KR); Ha Eun Lee, Jeonju-si (KR)

(73) Assignee: Industrial Cooperation Foundation Chonbuk National University, Jeonju-si, Jeollabuk-do (KR)

( * ) Notice: Subject to any disclaimer, the term of this patent is extended or adjusted under 35 U.S.C. 154(b) by 487 days.

(21) Appl. No.: 15/249,211

(22) Filed: Aug. 26, 2016

(65) Prior Publication Data

US 2017/0058419 A1 Mar. 2, 2017

(30) Foreign Application Priority Data

Aug. 28, 2015 (KR) ..... 10-2015-0122125

(51) Int. Cl.

| | |
|---|---|
| ***C25D 9/08*** | (2006.01) |
| ***D06M 10/00*** | (2006.01) |
| ***D06M 11/44*** | (2006.01) |
| ***D06M 11/36*** | (2006.01) |
| ***C23C 18/14*** | (2006.01) |
| ***C23C 18/12*** | (2006.01) |

(Continued)

(52) U.S. Cl.

CPC ..... *C25D 9/08* (2013.01); *C23C 18/1216* (2013.01); *C23C 18/1245* (2013.01);

(Continued)

(58) Field of Classification Search

CPC . C25D 9/08; C25D 17/16; C25D 5/48; C25D 9/04; C25D 9/10; C25D 9/12

(Continued)

(56) References Cited

U.S. PATENT DOCUMENTS 7,195,701 B2 * 3/2007 Byrd ..... C25D 9/02 204/202
2011/0223343 A1 * 9/2011 Wang ..... B82Y 30/00 427/457

(Continued)

FOREIGN PATENT DOCUMENTS

CN 102260046 A * 11/2011
JP 2002180372 A * 6/2002

OTHER PUBLICATIONS

"Increased Interface Strength in Carbon Fiber Composites through a ZnO Nanowire Interphase" by Lin et al., Adv. Funct. Mater. 19, pp. 2654-2660 (2009).*

(Continued)

*Primary Examiner* — Brian W Cohen
(74) *Attorney, Agent, or Firm* — Rabin & Berdo, P.C.

(57) ABSTRACT

A method for manufacturing metal oxide-grown carbon fibers including immersing carbon fibers in a solution for forming a metal oxide seed layer and electrodepositing a metal oxide seed on the surfaces of carbon fibers, or irradiating microwave thereto to form a metal oxide seed layer, and irradiating microwave to the metal oxide seed layer-formed carbon fibers to grow metal oxide. The method for manufacturing metal oxide-grown carbon fibers can reduce process time, and improve process energy efficiency and production efficiency. The method for manufacturing metal oxide-grown carbon fibers can offer metal oxide-grown carbon fibers with improved interfacial shear stress.

7 Claims, 5 Drawing Sheets

(51) Int. Cl.

| | |
|---|---|
| ***D01F 11/16*** | (2006.01) |
| ***D01F 11/12*** | (2006.01) |
| ***D06M 10/06*** | (2006.01) |
| ***C25D 5/48*** | (2006.01) |
| ***D06M 11/65*** | (2006.01) |
| ***D06M 101/40*** | (2006.01) |
| ***D06M 13/332*** | (2006.01) |

(52) U.S. Cl.
CPC ..... *C23C 18/14* (2013.01); *C25D 5/48* (2013.01); *D01F 11/123* (2013.01); *D01F 11/16* (2013.01); *D06M 10/003* (2013.01); *D06M 10/06* (2013.01); *D06M 11/36* (2013.01); *D06M 11/44* (2013.01); *D06M 11/65* (2013.01); *D06M 13/332* (2013.01); *D06M 2101/40* (2013.01)

(58) Field of Classification Search
USPC ..... 205/220, 229, 333, 320, 323
See application file for complete search history.

(56) References Cited

U.S. PATENT DOCUMENTS

2014/0060644 A1* 3/2014 Berson ..... C25D 5/56 136/256
2015/0187916 A1* 7/2015 Nakazumi ..... H01L 29/66969 257/43
2016/0297970 A1* 10/2016 Garoff ..... D01D 1/02

OTHER PUBLICATIONS

Machine translation of JP2002180372A.*
"Adhesive Force Measurement Between HOPG and Zinc Oxide as an Indicator for Interfacial Bonding of Carbon Fiber Composites" by Patterson et al., ACS Appl. Mater. Interfaces 7, pp. 15380-15387 (2015).*
"Preparation of Nanosized ZnO Arrays by Electrophoretic Deposition" by Wang et al., Electrochem. Solid-State Lett. 5(4), C53-C55 (2002).*
Machine translation of CN-102260046-A of Li et al. (Year: 2011).*

* cited by examiner

MANUFACTURING METHOD FOR CARBONFIBER GROWN METAL OXIDE

TECHNICAL FIELD

The present invention relates to a method for manufacturing carbon fibers including grown metal oxide (metal oxide-grown carbon fibers) with improved interfacial shear stress.

BACKGROUND ART

Conventional fiber-reinforced composite materials have a limited application range due to low interfacial shear stress in spite of excellent mechanical properties.

A variety of grafting methods are developed to improve interfacial shear stress of fiber-reinforced composite materials. However, most of the methods disadvantageously require high-temperature thermal treatment processes, have considerably long manufacturing time and poor bonding strength between carbon fibers and metal oxide, and are inapplicable to commercialization.

In an attempt to improve interfacial shear stress between fibers and a matrix in fiber-reinforced composite materials, methods for reducing surface free energy by applying a variety of surface treatment methods to fiber surfaces and imparting functional groups thereto are actively researched. However, most methods cause deterioration in physical properties of fibers and optimization of treatment conditions is difficult.

Accordingly, grafting methods which are capable of improving interfacial shear stress of fiber-reinforced composite materials and are applicable to commercialization, while causing deterioration in physical properties of fibers have been developed. Grafting methods have an effect of improving physical interfacial shear stress based on interlocking effects by growing a rod, wire or belt form of metal oxide in a direction vertical to a fiber length on fiber surfaces or other substrates such as metal, polymer and ceramic substrates and the like.

Grafting methods include a variety of methods such as hydrothermal synthesis, carbothermal reduction, chemical vapor deposition and thermal evaporation. Most methods include forming metal oxide by using a solution in which metal cations are dissolved or performing thermal treatment using metal particles as a precursor. However, most methods disadvantageously require vacuum conditions or a high temperature of 500° C. or higher, entail thermal treatment or have a very long manufacturing time, have bad bonding strength between carbon fibers and metal oxide, and are inapplicable to commercialization through continuous processes. In addition, the methods cause deterioration in physical properties of fibers, have limited application fields and are inapplicable to commercialization due to high-temperature application.

A hydrothermal method, which is one of grafting methods, can form a rod, wire or belt form of metal oxide on a substrate surface at a low temperature of 100° C. or less. In general, a hydrothermal method is divided into two steps. The first step is to form a seed on a substrate surface by thermal treatment in a seed solution and the second step is to deposit and then grow ions on the seed. However, the hydrothermal method requires a long time of 4 hours or longer, has low commerciality and is difficult to apply to continuous processes.

Accordingly, there is an urgent demand for development of new methods for forming metal oxides that are simple and are applicable to continuous processes in consideration of commercialization and have low cost and high production efficiency.

PRIOR ART DOCUMENT

Non-Patent Document (Non-Patent Document 001) B. Y. Lin, G. Ehlert, H. A. Sodano, "Increased interface strength in carbon fiber composites through a ZnO nanowire interphase", Adv. Funct. Mater, 2009, 19, 2654-2660.

(Non-Patent Document 002) B. P. Yang, H. Yan, S. Mao, R. Russo, J. Johnson, R. Saykally, N. Moris, J. Pham, R. He, H. J. Choi, "Controlled growth of ZnO nanowires and their optical properties", Adv. Funct. Mater, 2002, 12, 323-331.

(Non-Patent Document 003) L. E. Greene, M. Law, J. Goldberger, F. Kim, J. C. Johnson, Y. Zhang, R. J. Saykally, P. Yang, "Low-temperature wafer-scale production of ZnO nanowire arrays", Angewandte Chemie, 2003, 42, 2031-3034.

DISCLOSURE

Technical Problem

Therefore, it is one object of the present invention to provide a method of rapidly forming metal oxide on a fiber surface to improve interfacial shear stress of fiber-reinforced composite materials.

It is another object of the present invention to provide a method of forming metal oxide which is applicable to continuous processes by improving interfacial bonding strength between carbon fibers and metal oxide.

Technical Solution

In accordance with one aspect of the present invention, the above and other objects can be accomplished by the provision of a method for manufacturing metal oxide-grown carbon fibers including immersing carbon fibers in a solution for forming a metal oxide seed layer and then electrodepositing a metal oxide seed on the surfaces of the carbon fibers or irradiating microwave thereto to form a metal oxide seed layer, and irradiating microwave to the metal oxide seed layer-formed carbon fibers (the carbon fibers having the metal oxide seed layer) to grow metal oxide.

In another aspect of the present invention, provided is a method for manufacturing metal oxide-grown carbon fibers including spinning a carbon fiber seed, stabilizing and carbonizing the spun carbon fiber, forming a metal oxide seed layer on the stabilized and carbonized carbon fiber, and growing the metal oxide, wherein the forming the metal oxide seed layer comprises immersing the carbon fibers in a solution for forming a metal oxide seed layer and then electrodepositing a metal oxide seed on the surfaces of carbon fibers or irradiating microwave thereto to form a metal oxide seed layer, and the growing the metal oxide is carried out by irradiating microwave to the metal oxide seed layer-formed carbon fiber.

The grown metal oxide may be any one selected from the group consisting of a nanorod, a wire and a belt.

The method may further include surface treating the carbon fibers before forming the metal oxide seed layer.

The surface treatment may be carried out by a method selected from the group consisting of coupling agent treatment, plasma treatment, acid treatment and dopamine treatment.

The electrodeposition may be carried out in a device using the carbon fiber as a cathode, using an electrode plate as an anode and using the solution for forming a metal oxide seed layer as an electrolyte.

The electrode plate may include any one selected from the group consisting of aluminum, zinc, copper, iron, graphite, silver, gold, platinum and lead.

The solution for forming a metal oxide seed layer may include a solvent and a compound having a hydroxyl group (—OH).

The compound having a hydroxyl group (—OH) may include any one selected from the group consisting of potassium hydroxide (KOH), calcium hydroxide (CaOH), sodium hydroxide (NaOH), magnesium hydroxide ($Mg(OH)_2$), aluminum hydroxide ($Al(OH)_3$), zinc hydroxide ($Zn(OH)_2$), nickel hydroxide (NiOH), copper hydroxide ($Cu(OH)_2$) and a combination thereof.

The solvent may be water or alcohol. The alcohol may be any one selected from the group consisting of methanol, ethanol, propanol and butanol.

The solution for forming a metal oxide seed layer may further include any one selected from the group consisting of zinc acetate, copper chloride, nickel nitride, a hydrate thereof and a combination thereof.

The solution for forming a metal oxide seed layer may have a molar concentration of 0.0001 to 1M.

The irradiation of microwave in the formation of the metal oxide seed layer may be carried out at a charge density of 0.001 to 10 $C/cm^2$ for 0.1 seconds to 1 hour.

The frequency of the microwave may be 300 to 30,000 MHz.

The power of microwave may be 100 to 2000 W.

The microwave irradiation time may be 5 seconds to 2 hours.

The growing the metal oxide may include immersing the metal oxide seed layer-formed carbon fibers in an aqueous solution and then growing metal oxide in the aqueous solution.

The aqueous solution may include nitride.

The nitride may include any one selected from the group consisting of zinc nitrate hydrate, zinc nitrate hexahydrate, hexamethylenetetramine (HMTA) and a combination thereof.

The molar concentration of the aqueous solution may be 0.0001 to 5M.

The temperature of the aqueous solution may be 25 to 400° C.

Effects of the Invention

The method for manufacturing metal oxide-grown carbon fibers according to the present invention can reduce process time, and improve process energy efficiency and production efficiency.

The method for manufacturing metal oxide-grown carbon fibers according to the present invention can offer metal oxide-grown carbon fibers with improved interfacial shear stress.

DESCRIPTION OF DRAWINGS

The above and other objects, features and other advantages of the present invention will be more clearly understood from the following detailed description taken in conjunction with the accompanying drawings, in which.

BEST MODE

The present invention covers various alterations and includes various embodiments, and certain embodiments will be exemplified and described in detail in the Detailed Description of the Invention. However, the present invention should not be construed as limited to certain embodiments and the present invention includes modifications, additions and substitutions within the spirit and technical scope of the present invention.

The terms used herein are used merely to describe specific embodiments, but are not intended to limit the present invention. The singular expressions include plural expressions unless explicitly stated otherwise in the context thereof. It should be appreciated that in this application, the terms "include(s)," "comprise(s)", "including" and "comprising" are intended to denote the presence of the characteristics, numbers, steps, operations, elements, or components described herein, or combinations thereof, but do not exclude the probability of presence or addition of one or more other characteristics, numbers, steps, operations, elements, components, or combinations thereof.

The method for manufacturing metal oxide-grown carbon fibers according to an embodiment of the present invention includes immersing carbon fibers in a solution for forming a metal oxide seed layer and then electrodepositing a metal oxide seed on the surfaces of the carbon fibers, or irradiating microwave thereto to form a metal oxide seed layer, and irradiating microwave to the carbon fibers on which the metal oxide seed layer is formed to grow metal oxide.

Meanwhile, the method for manufacturing metal oxide-grown carbon fibers can be performed as a part of a continuous process of manufacturing carbon fibers. In this case, the method for manufacturing metal oxide-grown carbon fibers includes a continuous process including spinning a carbon fiber seed, stabilizing and carbonizing the spun carbon fiber, forming a metal oxide seed layer on the stabilized and carbonized carbon fiber, and growing the metal oxide wherein the step of forming the metal oxide seed layer includes immersing the carbon fibers in a solution for forming a metal oxide seed layer and then electrodepositing a metal oxide seed on the surfaces of the carbon fibers, or irradiating microwave thereto to form a metal oxide seed layer. The step of growing includes irradiating microwave to the carbon fibers having the metal oxide seed layer to form metal oxide. The grown metal oxide is preferably selected from the group consisting of a nanorod, a wire and a belt.

Figure 1:
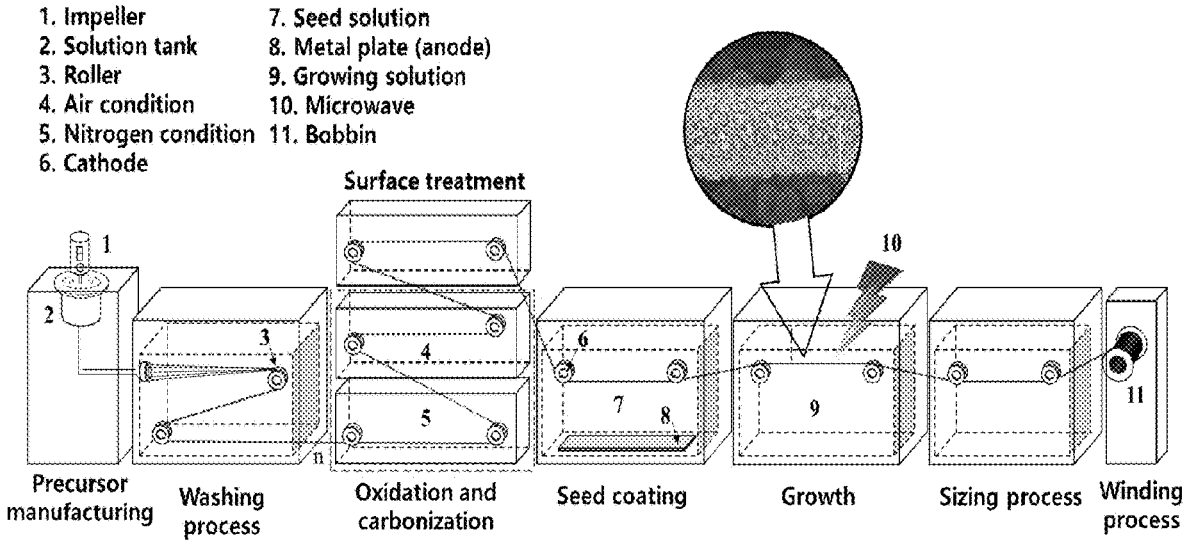
FIG. 1 is a schematic diagram illustrating a continuous process for manufacturing metal oxide-grown carbon fibers according to an embodiment of the present invention.
Figure 2:
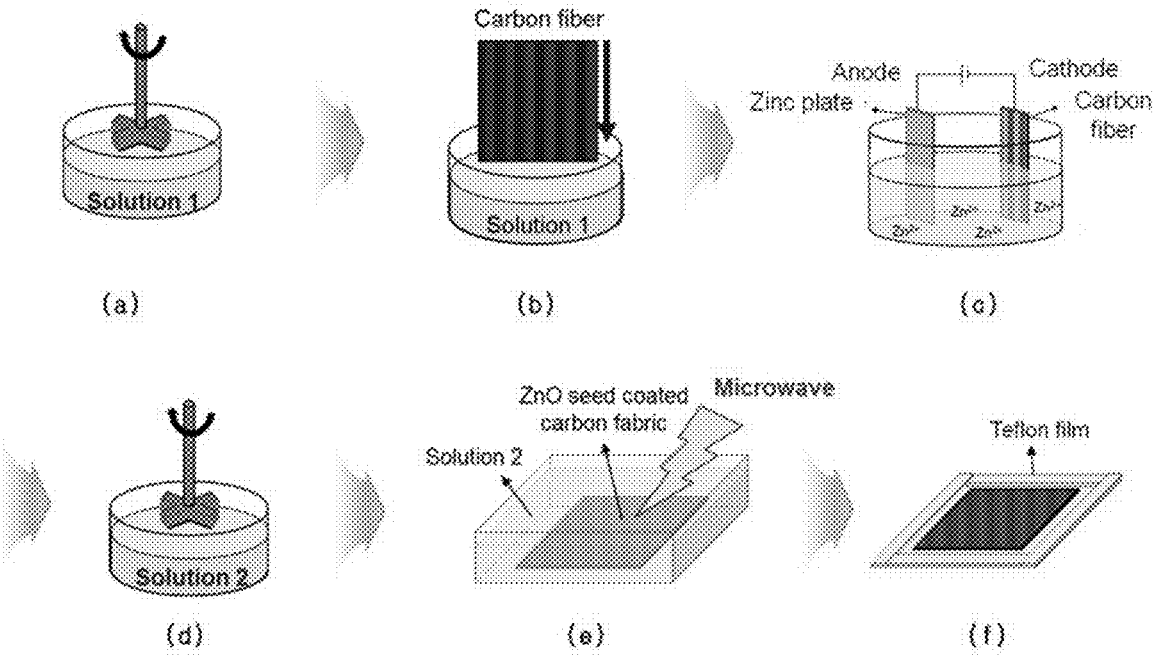
FIG. 2 is a schematic diagram illustrating electrodeposition in the continuous process for manufacturing metal oxide-grown carbon fibers according to an embodiment of the present invention.
Figure 3:
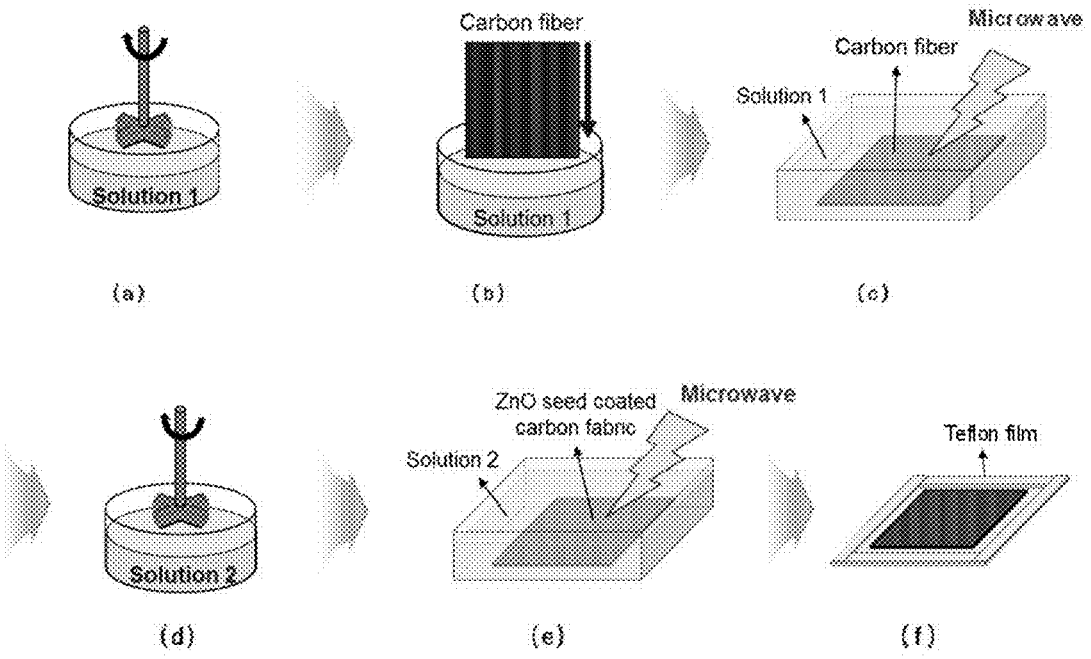
FIG. 3 is a schematic diagram illustrating microwave irradiation in the continuous process for manufacturing metal oxide-grown carbon fibers according to an embodiment of the present invention.

FIG. 1 is a schematic diagram illustrating a continuous process for manufacturing metal oxide-grown carbon fibers according to an embodiment of the present invention, FIG. 2 is a schematic diagram illustrating electrodeposition in the continuous process for manufacturing metal oxide-grown carbon fibers according to an embodiment of the present invention, and FIG. 3 is a schematic diagram illustrating microwave irradiation in the continuous process for manufacturing metal oxide-grown carbon fibers according to an embodiment of the present invention. Hereinafter, the method for manufacturing metal oxide-grown carbon fibers will be described in detail with reference to FIGS. 1 to 3.

(i) Surface-Treatment of Carbon Fibers

The method for manufacturing metal oxide-grown carbon fibers may optionally further include surface-treating the carbon fibers before forming the metal oxide seed layer.

The surface treatment may be carried out by a method selected from the group consisting of coupling agent treatment, plasma treatment, acid treatment and dopamine treatment.

An ordinary method for manufacturing metal oxide-grown carbon fibers has a problem of detachment of metal oxide from the carbon fiber surface due to friction between carbon fibers and a roller in the manufacturing process. In order to apply the manufacturing process to a continuous process, interfacial bonding strength between carbon fibers and metal oxide should be improved. Accordingly, in the present invention, surface treatment such as coupling agent treatment, plasma treatment, acid treatment and dopamine treatment can be performed on the carbon fiber surface to improve interfacial bonding strength between carbon fibers and metal oxide.

(ii-1) Electrodepositing Metal Oxide Seed on Carbon Fiber Surface to Form Metal Oxide Seed Layer The step of forming the metal oxide seed layer may be carried out in an apparatus utilizing the carbon fiber as a cathode, an electrode plate as an anode and the solution for forming a metal oxide seed layer as an electrolyte. FIG. 2 illustrates a case of using the electrodeposition method.

The step of forming the metal oxide seed layer can determine the diameter and shape of the metal oxide. Accordingly, the method for manufacturing metal oxide-grown carbon fibers selectively determines the thickness of the metal oxide seed layer by controlling current and treatment time in consideration of the area of the carbon fiber.

Since metal cations should be attracted to the carbon fiber surface in order to form the metal oxide seed layer, preferably, the carbon fiber is connected to the cathode and the electrode plate is connected to the anode. The electrode plate is preferably a metal plate having lower reactivity than the cations of the metal oxide seed. When the treatment time is long, an electrode plate having the same cations as the metal of the metal oxide seed is preferably used to prevent a phenomenon in which other ions are formed on carbon fibers and cause defects due to continuous supply of metal cations, but the present invention is not limited thereto. A conductive material such as a graphite plate may be also used as the electrode plate.

For example, the electrode plate may be any one selected from the group consisting of aluminum, zinc, copper, iron, graphite, silver, gold, platinum and lead.

Meanwhile, the electrolyte may include a solvent and a compound having a hydroxyl group (—OH).

The solvent may be water or alcohol. The alcohol may be any one selected from the group consisting of methanol, ethanol, propanol and butanol.

The compound having a hydroxyl group (—OH) can help form a metal oxide seed layer owing to high stability constant ($lg\beta_4$). The formation of the metal oxide seed layer is affected by solubility of the compound having a hydroxyl group. The formation of the metal oxide seed layer by electrodeposition and microwave irradiation can be carried out by performing electrodeposition and microwave irradiation while controlling solubility using a variety of temperatures ranging from a low temperature (−30° C.) to a high temperature (100° C.) depending on the type of the solution containing the compound having a hydroxyl group in consideration of this fact.

The compound having a hydroxyl group may be any one selected from the group consisting of potassium hydroxide (KOH), calcium hydroxide (CaOH), sodium hydroxide (NaOH), magnesium hydroxide ($Mg(OH)_2$), aluminum hydroxide ($Al(OH)_3$), zinc hydroxide ($Zn(OH)_2$), nickel hydroxide (NiOH), copper hydroxide ($Cu(OH)_2$) and a combination thereof.

In addition, the electrolyte may further include any one selected from the group consisting of zinc acetate, copper chloride, nickel nitride, a hydrate thereof and a combination thereof. The hydrate may be zinc acetate dihydrate, copper chloride dihydrate, nickel nitrate hexahydrate or the like.

A molar concentration of the electrolyte may be 0.0001 to 1M.

The electrodeposition of the metal oxide may be carried out by treating a charge density of 0.001 to 10 $C/cm^2$ for 0.1 seconds to 1 hour.

(ii-2) Immersing Carbon Fiber in Solution for Forming Metal Oxide Seed Layer and Irradiating Microwave to Carbon Fiber Surface to Form Metal Oxide Seed Layer The electrodeposition of process ii-2 may be replaced by a microwave irradiation method. In this case, specifically, the carbon fibers are immersed in a solution for forming a metal oxide seed layer and microwave is irradiated to the surfaces of carbon fibers to form a metal oxide seed layer. FIG. 3 illustrates a case of using the microwave irradiation method.

In this case, the solution for forming a metal oxide seed layer may include the same ingredients as the electrolyte of process ii-2.

Microwave intensity can be controlled to adjust the required temperature depending on the type of the metal oxide seed. In addition, to control the thickness of the metal oxide seed layer, the microwave irradiation time and the microwave treatment frequency can be controlled. When the microwave treatment frequency is controlled, metal cations can be sufficiently supplied by changing the electrolyte.

Preferably, the microwave may have a frequency of 300 to 30,000 MHz and the microwave power may be 100 to 2000 W.

The microwave irradiation time may be 5 seconds to 2 hours.

The thickness of the metal oxide seed layer can be controlled by controlling the microwave irradiation time, power and frequency.

The method for manufacturing metal oxide-grown carbon fibers according to the present invention uses electrodeposition or microwave irradiation, thereby reducing the process time by 96% or more as compared to conventional hydrothermal methods, and is applicable to mass-production and a continuous process.

(iii) Irradiating Microwave to Metal Oxide Seed Layer-Formed Carbon Fiber to Grow Metal Oxide In this case, the microwave may have a frequency of 300 to 30,000 MHz, the microwave power may be 100 to 2,000 W, and the microwave irradiation time may be 5 seconds to 2 hours.

The microwave irradiation time is sufficiently high to form the metal oxide in the form of a rod, wire or belt.

In addition, the length of the rod, wire or belt can be controlled by controlling time according to the type of the metal oxide.

The step of growing metal oxide may be carried out in an aqueous solution in which the carbon fiber is immersed.

The aqueous solution may include nitride, and the nitride is preferably any one selected from the group consisting of zinc nitrate hydrate, zinc nitrate hexahydrate, hexamethylenetetramine (HMTA) and a combination thereof. Specifically, the aqueous solution may further include the hexamethylenetetramine together with metal nitride of the same metal as the metal of the metal oxide.

The aqueous solution may have a molar concentration of 0.0001 to 5M. The molar concentration of the aqueous solution should be maintained at a sufficient level to supply metal cations. When the molar concentration is less than 0.0001M, the metal oxide may not be grown.

The aqueous solution may have a temperature of 25 to 400° C.

The microwave irradiation time in the growth of the metal oxide seed may be 30 seconds to 2 hours.

By the growth of the metal oxide, the present invention can manufacture metal oxide nanorods (NRs) with a height of 50 and a size of 200 μm.

The metal oxide thus manufactured exhibits interlocking effects and interfacial shear stress improved by wide specific surface area. Accordingly, the metal oxide-grown carbon fibers exhibit improved interfacial shear stress.

Unlike conventional hydrothermal methods, the present invention is capable of forming uniform metal oxide seeds on a substrate within a few minutes using an electrodeposition method or microwave irradiation and is easy to grow metal oxide within a short time using microwaves.

The suggested method can offer rapid heating to a treatment temperature within a short time and thus improve energy efficiency, thus improving production efficiency and remarkable economic effects when applied to a continuous process.

The metal oxide-grown carbon fibers produced by the present invention can solve interfacial shear stress, the endemic problem of conventional metal oxide-grown carbon fibers and can be used to produce composite materials with excellent performance which are applicable to a variety of fields such as aviation, aerospace, ships and cars.

Hereinafter, embodiments according to the present invention will be described in detail to such an extent that a person having ordinary knowledge in the art field to which the invention pertains can easily carry out the invention. However, the present invention can be realized in various forms and is not limited to embodiments stated herein.

Preparation Example: Production of Metal Oxide-Grown Carbon Fibers

Example 1

With reference to FIG. 2, a process for manufacturing metal oxide-grown carbon fibers of Example 1 will be described in detail.

(a) 0.1M zinc acetate dihydrate and 0.00285M zinc hydroxide (volume ratio=18:7) were dissolved in 50° C. water to prepare a solution for forming a metal oxide seed layer (solution 1).

(b) Carbon fibers were immersed in the prepared solution for forming a metal oxide seed layer.

(c) Using the solution for forming a metal oxide seed layer as an electrolyte, carbon fibers were connected to a cathode and a zinc plate was connected to an anode, a current of 0.06 Å was applied for 48 seconds to apply a charge density of 0.4 C/cm$^2$ (0.06 Å, 48 s) to form a metal oxide seed layer.

(d) 0.025M zinc nitrate hydrate and 0.025M hexamethylenetetramine (HMTA) were dissolved in water to form an aqueous solution for growing metal oxide (solution 2).

(e) The metal oxide seed layer-formed carbon fibers were immersed in the prepared aqueous solution for growing metal oxide and microwave was irradiated at 700 W for 10 minutes to form zinc oxide (ZnO) nanorods (NRs).

(f) The zinc oxide nanorod-grown carbon fibers were washed with deionized (DI) water and dried at 80° C.

Example 2

With reference to FIG. 3, a process for manufacturing metal oxide-grown carbon fibers of Example 2 will be described in detail.

(a) 0.1M zinc acetate dihydrate and 0.00285M zinc hydroxide (volume ratio=18:7) were dissolved in 50° C. water to prepare a solution for forming a metal oxide seed layer (solution 1).

(b) Carbon fibers were immersed in the prepared solution for forming a metal oxide seed layer.

(c) Microwave was irradiated at 700 W for 10 minutes to carbon fibers immersed in the solution for forming a metal oxide seed layer to form a metal oxide seed layer.

(d) 0.025M zinc nitrate hydrate and 0.025M hexamethylenetetramine (HMTA) were dissolved in water to form an aqueous solution for growing metal oxide (solution 2).

(e) The metal oxide seed layer-formed carbon fibers were immersed in the prepared aqueous solution for growing metal oxide and microwave was irradiated at 700 W for 10 minutes to form zinc oxide (ZnO) nanorods (NRs).

(f) The zinc oxide nanorod-grown carbon fibers were washed with deionized (DI) water and dried at 80° C.

Examples 1 to 7 and Comparative Examples 1 to 2

Metal oxide-grown carbon fibers of Comparative Examples and Examples were produced in the same manner as in Example 1 or 2 using the composition shown in the following Table 1.

TABLE 1

| | Forming metal oxide seed layer | | | Growing metal oxide | |
|---|---|---|---|---|---|
| | Aqueous solution 1[1)] | Electrodeposition conditions | Microwave conditions | Aqueous solution 2[2)] | Microwave conditions |
| Example 1 | 0.1 M zinc acetate dihydrate zinc hydroxide 0.00285 M | 0.4 C/cm$^2$ 0.06 Å 48 sec | | 0.025 M zinc nitrate hydrate 0.025 M HMTA | 700 W 10 min |
| Example 2 | 0.1 M zinc acetate dihydrate zinc hydroxide 0.00285 M | | 700 W 3 min | 0.025 M zinc nitrate hydrate 0.025 M HMTA | 700 W 3 min |
| Example 3 | 0.1 M zinc acetate dihydrate 0.00285 M copper hydroxide | 0.4 C/cm$^2$ 0.06 Å 48 sec | | 0.025 M zinc nitrate hydrate 0.025 M HMTA | 700 W 10 min |
| Example 4 | 0.1 M zinc acetate dihydrate | 0.4 C/cm$^2$ 0.06 Å 48 sec | | 0.025 M zinc nitrate hydrate 0.025 M HMTA | 700 W 10 min |
| Example 5 | 0.1 M zinc acetate dihydrate zinc hydroxide 0.00285 M | 0.4 C/cm$^2$ 0.2 Å 14 sec | | 0.025 M zinc nitrate hydrate 0.025 M HMTA | 700 W 10 min |
| Example 6 | 0.0014 M zinc acetate dihydrate zinc hydroxide 0.00285 M | 0.4 C/cm$^2$ 0.06 Å 48 sec | | 0.025 M zinc nitrate hydrate 0.025 M HMTA | 700 W 10 min |
| Example 7 | 0.1 M zinc acetate dihydrate 0.00285 M zinc hydroxide change of solution during microwave irradiation | | 700 W 10 min | 0.025 M zinc nitrate hydrate 0.025 M HMTA | 700 W 10 min |
| | Change of solution during microwave irradiation | | | | |
| Comparative Example 1 | Epoxy-sized fiber | | | Hydrothermal method | |
| Comparative Example 2 | Plasma-treated fiber | | | Hydrothermal method | |

[1)]Aqueous solution 1: solution for forming metal oxide seed layer
[2)]Aqueous solution 2: solution for growing metal oxide

Figure 4A:
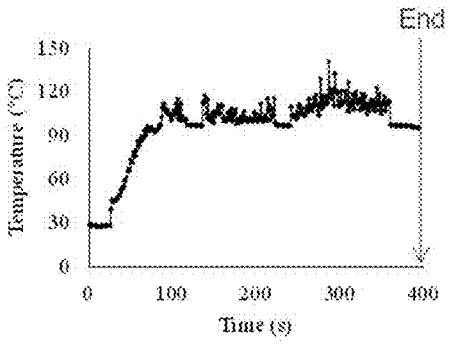
FIG. 4A is a graph showing the temperature of the solution for forming a metal oxide seed measured during microwave irradiation in the formation of the metal oxide seed layer of Example 2.
Figure 4B:
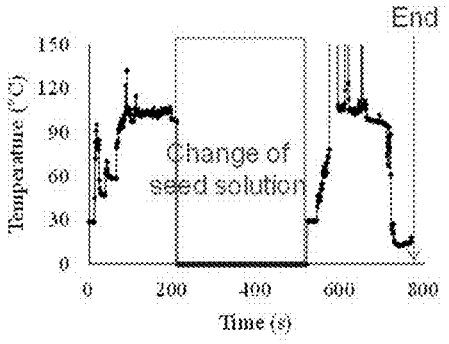
FIG. 4B is a graph showing the temperature of the solution for forming a metal oxide seed measured during microwave irradiation in the formation of the metal oxide seed layer of Example 7.
Figure 4C:
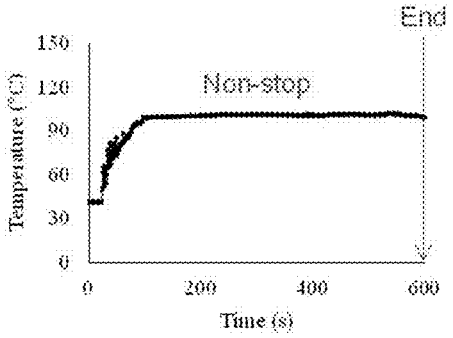
FIG. 4C is a graph showing the temperature of the aqueous solution for growing metal oxide measured during microwave irradiation in the growth of metal oxide of Examples 2 and 7.

Test Example 1: Measurement of Temperature Change During Microwave Irradiation The temperature of the solution for forming a metal oxide seed was measured during microwave irradiation in the forming the metal oxide seed layer of Example 2 and results are shown in FIG. 4A. The temperature of the solution for forming a metal oxide seed was measured during microwave irradiation in the forming the metal oxide seed layer of Example 7 and results are shown in FIG. 4B. In addition, the temperature of the aqueous solution for growing metal oxide was measured during microwave irradiation in the growth of metal oxide of Examples 2 and 7 and results are shown in FIG. 4C.

As can be seen from FIG. 4, the suitable growth temperature of metal oxide could be rapidly increased using microwave and in this Example, and the temperature for growth of zinc oxide could be increased to a suitable level using 700 W of microwave.

Test Example 2: Observation with Scanning Electron Microscope

ZnO NRs formed on carbon fiber surfaces of Examples 1 to 7 and Comparative Examples 1 and 2 were observed using a scanning electron microscope (SEM).

Figure 5:
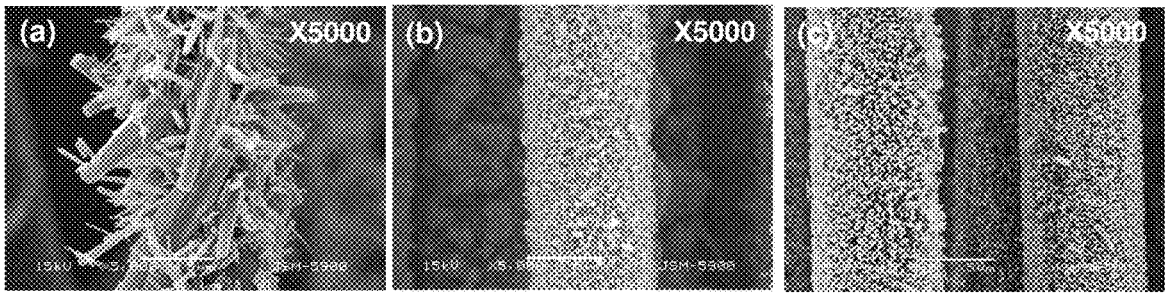
FIG. 5 is a scanning electron microscope image showing the shape of ZnO NRs formed on the carbon fiber surfaces of Comparative Example 1 (FIG. 5(*a*)), Example 1 (FIG. 5(*b*)) and Example 2 (FIG. 5(*c*))

FIG. 5 is scanning electron microscope images showing ZnO NRs formed on the carbon fiber surfaces of Example 1 (FIG. 5(*b*)), Example 2 (FIG. 5(*c*)) and Comparative Example 1 (FIG. 5A). As can be seen from FIG. 5, when metal oxide-grown carbon fibers are produced by a conventional hydrothermal method like Comparative Example 1, relatively non-uniform ZnO NRs were randomly grown. On the other hand, like Examples 1 and 2, when both electrodeposition and microwave irradiation are used, dense and uniform ZnO NRs were formed in a fiber diameter direction.

Figure 6:
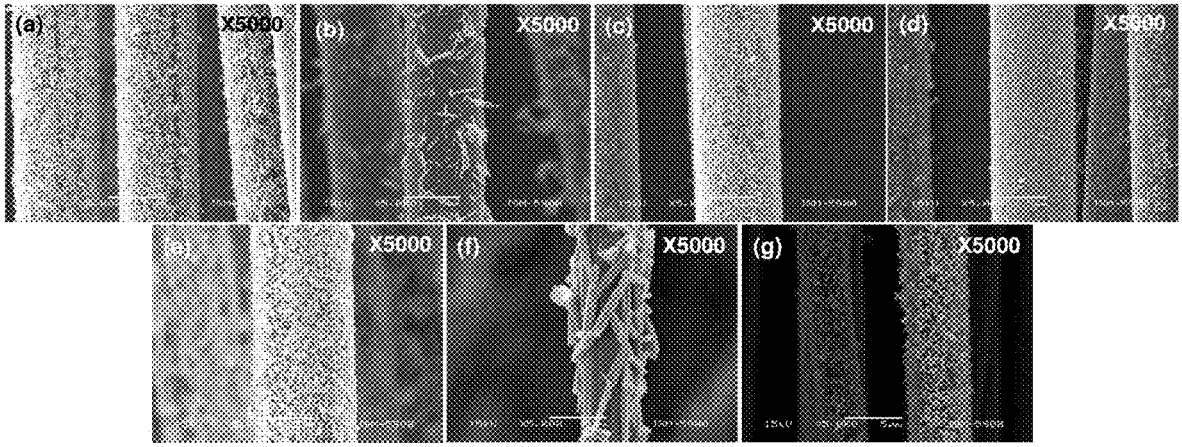
FIG. 6 is a scanning electron microscope image showing the shape of ZnO nanorods formed on carbon fiber surfaces of Examples 3 to 7, and Comparative Example 1.

FIG. 6A shows results of observation of ZnO NRs produced in Example 3 using copper hydroxide instead of zinc hydroxide with a scanning electron microscope to confirm an effect of the type of compound having a hydroxyl group contained in the solution for forming a metal oxide seed layer. The copper hydroxide has lower reactivity than a zinc cation used as a metal plate and thus excludes an effect on formation of the metal oxide seed layer. As a result, it can be seen that ZnO NRs are uniformly formed in a fiber diameter direction.

FIG. 6B shows results of observation of ZnO NRs of Example 4 produced using only 0.1M zinc acetate dihydrate, instead of the compound having a hydroxyl group, with a scanning electron microscope to confirm an effect of the type of compound having a hydroxyl group contained in the solution for forming a metal oxide seed layer. As a result, the metal oxide seed layer could not be formed on the carbon fiber surface and zinc oxide nanorods grown on the periphery were randomly adhered to the carbon fiber surface.

FIG. 6C shows results of observation of ZnO NRs produced in Example 5 to which 0.2 A of microwave was applied for 14 seconds (0.4 C/cm$^2$) with a scanning electron microscope to confirm effects of voltage and treatment time at an identical charge density upon electrodeposition. As a result, it can be seen that an electrodeposition method is preferably applied within the suggested charge density of 0.001 to 10 C/cm$^2$ while being not greatly influenced by voltage and treatment time.

FIG. 6D shows results of observation of ZnO NRs produced in Example 6 in which 0.0014M zinc acetate dihydrate was used, with a scanning electron microscope to confirm an effect of a molar concentration of zinc acetate dihydrate contained in the solution for forming a metal oxide seed layer. As a result, substantially uniform zinc oxide nanorods were formed, but zinc oxide nanorods were shown in adjacent some fibers, which indicates that a sufficient amount of zinc cations for forming the metal oxide seed layer was not supplied.

FIG. 6E shows results of observation using a scanning electron microscope, of ZnO NRs produced in Example 7 in which the solution for forming a metal oxide seed layer was replaced with a new one during microwave irradiation to sufficiently supply metal cations in the forming the metal oxide seed layer. As a result, ZnO NRs were formed in the same level as in Example 1, which indicates that 0.1M zinc acetate dihydrate has a sufficient molar concentration to supply metal cations. When the molar concentration of the zinc acetate dihydrate is low, changing the solution for forming the oxide seed layer with a new one was effective.

FIG. 6F is a scanning electron microscope image showing zinc oxide nanorods grown on surfaces of commercially available epoxy-sized carbon fibers using a conventional hydrothermal method according to Comparative Example 1. The metal oxide seed layer was not formed on carbon fiber surfaces by epoxy sizing and fibers were substantially adhered in a length direction.

In addition, since the carbon fiber surface has a very low surface free energy and has no functional groups which can be bonded to other heteromaterials, very non-uniform metal oxide is formed by a conventional hydrothermal method like Comparative Examples 1 and 2. Accordingly, surface free energy is increased and a functional group is imparted by surface treatment of carbon fibers using plasma, so that formation of metal oxide was confirmed. As a result, as shown in FIG. 6G, in a case in which the electrodeposition method and microwave according to the present invention are used, zinc oxide nanorods were relatively sparsely distributed, but formed in a diameter direction of carbon fibers.

Test Example 3: Evaluation of Interfacial Shear Stress

Figure 7:
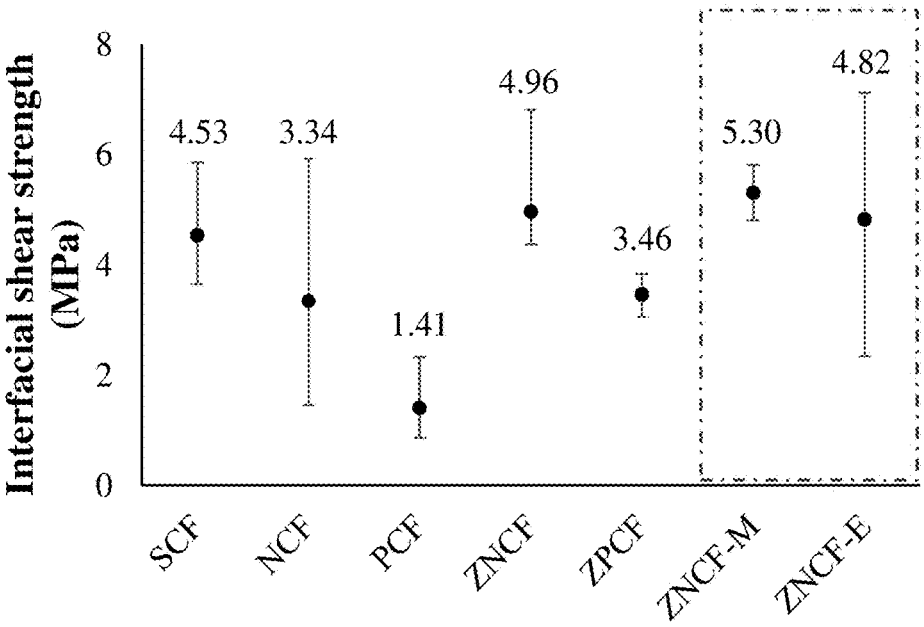
FIG. 7 shows results of interfacial shear stress test performed on carbon fibers produced in Comparative Examples 2-1 to 2-5 and Examples 2-1 to 2-2.

FIG. 7 shows results of interfacial shear stress test performed on carbon fibers produced in Comparative Examples 2-1 to 2-5 and Examples 2-1 to 2-2.

In FIG. 7, SCF represents results of sized-carbon fibers, NCF represents results of neat carbon fibers, PCF represents results of plasma-treated carbon fibers, ZNCF represents results of neat carbon fibers on which ZnO NRs are grown by a hydrothermal method, ZNCF-M represents results of growth of zinc oxide nanorods by microwave using neat carbon fibers, and ZNCF-E shows growth of nanorods after formation of the zinc oxide seed by an electrodeposition method using neat carbon fibers.

Referring to FIG. 7, when microwave irradiation and electrodeposition are used, a similar interfacial shear stress to conventional hydrothermal methods is obtained. As a result, it was proved that the method for manufacturing metal oxide-grown carbon fibers according to the present invention is an excellent process, which can reduce the process time by 96% while maintaining interfacial shear stress.

Although the preferred embodiments of the present invention have been disclosed for illustrative purposes, those skilled in the art will appropriate that various modifications, additions and substitutions are possible, without departing from the scope and spirit of the invention as disclosed in the accompanying claims.

What is claimed is:

1. A method for manufacturing metal oxide coated carbon fibers comprising:

immersing carbon fibers in a solution for forming a metal oxide seed layer, wherein the solution for forming the metal oxide seed layer comprises a solvent and zinc hydroxide ($Zn(OH)_2$), electrodepositing a metal oxide seed on surfaces of the immersed carbon fibers; and growing a metal oxide on the carbon fiber by irradiating microwaves to the metal oxide seed layer coated carbon fibers, wherein the metal oxide is a nanorod or a wire, the metal oxide is grown in a direction vertical to a carbon fiber length on the surfaces of the carbon fibers, and interlocks the carbon fibers, wherein the metal oxide is grown by immersing the metal oxide seed layer-coated carbon fibers in a nitride-containing aqueous solution and then irradiating the metal oxide in the nitride-containing aqueous solution with microwaves, and wherein the nitride comprises metal nitride and hexamethylenetetramine (HMTA).

2. The method according to claim 1, further comprising treating the surface of the carbon fibers before forming the metal oxide seed layer, wherein the treating the surface is carried out by a method selected from the group consisting of coupling agent treatment, plasma treatment, acid treatment and dopamine treatment.

3. The method according to claim 1, wherein the metal oxide seed layer forming solution further comprises any one selected from the group consisting of zinc acetate, copper chloride, nickel nitride, a hydrate thereof and a combination thereof.

4. The method according to claim 1, wherein the irradiation of microwave is carried out at a microwave power of 100 to 2000 W, at a frequency of 300 to 30,000 MHz and at a charge density of 0.001 to 10 C/cm$^2$ for 0.1 seconds to 2 hours.

5. A method for manufacturing metal oxide coated carbon fibers comprising:

spinning a carbon fiber seed;

stabilizing and carbonizing the spun carbon fiber;

forming a metal oxide seed layer on the stabilized and carbonized carbon fiber;

and growing a metal oxide, wherein the forming the metal oxide seed layer comprises immersing carbon fibers in a solution for forming a meta oxide seed layer and then electrodepositing a metal oxide seed on surfaces of the carbon fibers, wherein the growing the metal oxide is carded out by irradiating microwave to the metal oxide seed layer-formed carbon fiber, wherein the solution for the metal oxide seed layer comprises a solvent and zinc hydroxide ($Zn(OH)_2$), wherein the metal oxide is a nanorod or a wire, the metal oxide is grown in a direction vertical to a carbon fiber length on the surfaces of the carbon fibers, and interlocks the carbon fibers, wherein the metal oxide is grown by immersing the metal oxide seed layer-formed carbon fibers in a nitride-containing aqueous solution and then growing the metal oxide in the nitride-containing aqueous solution, and wherein the nitride comprises metal nitride and hexamethylenetetramine (HMTA).

6. The method according to claim 1, wherein the electrodeposition is carried out in a device using the carbon fibers as a cathode, using an electrode plate as an anode and using the solution for forming the metal oxide seed layer as an electrolyte.

7. The method according to claim 6, wherein the electrode plate comprises any one selected from the group consisting of aluminum, zinc, copper, iron, graphite, silver, gold, platinum and lead.

* * * * *